US005169674A

United States Patent [19]

Miller

[11] Patent Number: 5,169,674

[45] Date of Patent: Dec. 8, 1992

[54] METHOD OF APPLYING A THERMAL BARRIER COATING SYSTEM TO A SUBSTRATE

[75] Inventor: Robert A. Miller, Brecksville, Ohio

[73] Assignee: The United States of America as represented by the Administrator of the National Aeronautics and Space Administration, Washington, D.C.

[21] Appl. No.: 708,255

[22] Filed: May 23, 1991

Related U.S. Application Data

[62] Division of Ser. No. 601,957, Oct. 23, 1990, abandoned.

[51] Int. Cl.[5] ..... B05D 1/02; B05D 3/12; B05D 7/14

[52] U.S. Cl. ..... 427/456; 427/367; 427/404; 427/419.2

[58] Field of Search ..... 427/34, 423, 53.1, 224, 427/383.3, 383.1, 383.5, 367, 383.7, 404, 419.2

[56] References Cited

U.S. PATENT DOCUMENTS

| | | | |
|---|---|---|---|
| 2,696,662 | 12/1954 | LeSech | 428/624 |
| 3,031,331 | 4/1962 | Aves, Jr. et al. | 117/46 |
| 3,086,284 | 4/1963 | Schetky | 29/183.5 |
| 3,911,891 | 10/1975 | Dowell | 427/34 |
| 4,055,705 | 10/1977 | Stecura et al. | 428/633 |
| 4,145,481 | 3/1979 | Gupta et al. | 427/34 |
| 4,248,940 | 2/1981 | Goward et al. | 428/633 |
| 4,402,992 | 9/1983 | Liebert | 427/34 |
| 4,405,284 | 9/1983 | Albrecht et al. | 427/34 |
| 4,405,659 | 9/1983 | Strangman | 427/367 |
| 4,451,496 | 5/1984 | Gedwill et al. | 427/34 |
| 4,481,237 | 11/1984 | Bosshart et al. | 427/34 |
| 4,485,151 | 11/1984 | Stecura | 428/680 |
| 4,576,874 | 3/1986 | Spengler et al. | 427/34 |
| 4,599,270 | 7/1986 | Rangaswamy et al. | 427/423 |
| 4,852,542 | 8/1989 | Kamo et al. | 123/668 |
| 4,877,689 | 10/1989 | Onstott | 428/680 |
| 4,904,542 | 2/1991 | Mroczkowski | 428/660 |
| 4,937,930 | 7/1990 | Humenik et al. | 427/367 |

*Primary Examiner*—Marianne Padgett

*Attorney, Agent, or Firm*—Gene E. Shook; Guy M. Miller; James A. Mackin

[57] ABSTRACT

A metallic "close-out" layer is applied to the surface of a thermal barrier coating system to seal the ceramic material in the coating. The "close-out" layer is glass-bead preened to densify the surface.

1 Claim, 1 Drawing Sheet

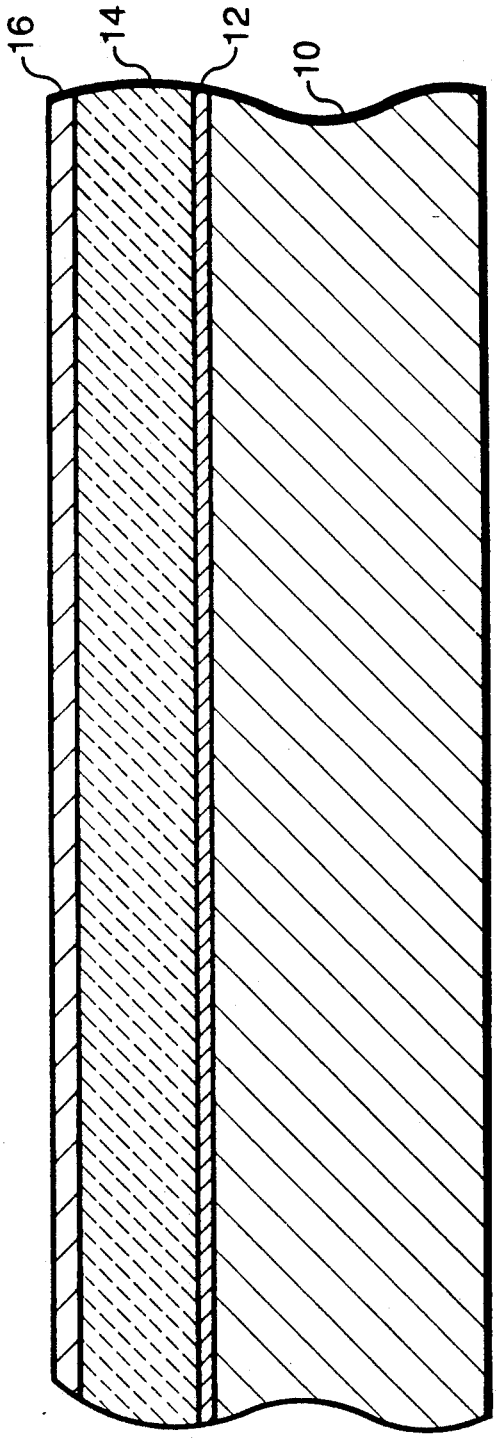
16
14
12
10

METHOD OF APPLYING A THERMAL BARRIER COATING SYSTEM TO A SUBSTRATE

Origin of the Invention

The invention described herein was made by an employee of the United States Government and may be manufactured and used by or for the Government for governmental purposes without the payment of any royalties thereon or therefor.

STATEMENT OF COPENDENCY

This application is a division of application Ser. No. 601,957 which was filed Oct. 23, 1990, now abandoned.

TECHNICAL FIELD

This invention is concerned with protecting a thermal barrier coating system. The invention is particularly concerned with sealing thermal barrier coating systems of the type in use and being contemplated for use in diesel and other internal combustion engines. The invention also would find application in moderately high temperature regions of gas turbine engines and any other application employing a thermal barrier coating at moderate temperatures.

Insulating, ceramic-based thermal barrier coatings are being applied to the piston heads and other hot section metallic components in diesel and gasoline internal combustion engines. Such coatings protect the underlying metal from the hot gases in the engine and retain a greater portion of the heat energy in the exhaust gases for subsequent extraction by such processes as turbocharging.

A range of thermal barrier coating configurations is being contemplated.

The range extends from coating systems having a thin two mil ceramic layer applied over a metallic bond coat layer to thick coating systems consisting of the ceramic layer, the bond coat layer, and intermediate layers of mixed metal and ceramic. Total thicknesses up to 140 mils have been contemplated for the thick coating systems. The outer surfaces of the ceramic layers are expected to be approximately in the range of 900° F. to 1300° F. (480° C. to 700° C.), depending on coating thickness and engine design.

Thermal barrier coatings, which are generally applied by air plasma spraying, have interconnected porosity which helps to lower the thermal conductivity and increase the strain tolerance. At the same time, the interconnected porosity provides an open path for the hot gases in an engine. This is a concern in the internal combustion engine due to the intermittent nature of the combustion, and it is a concern for many other thermal barrier coating applications where the open porosity can allow oxidizing or otherwise corrosive gases or condensates to enter into the coating. While plastic type sealers are available for temperature below about 500° F. (260° C.), the task of sealing a thermal barrier coating at higher temperature is less straight forward.

It is, therefore, an object of the present invention to provide a method for sealing thermal barrier coating systems at surface temperatures between about 570° F. (300° C.) and about 1300° F. (700° C.)

BACKGROUND ART

U.S. Pat. No. 4,055,705 to Stecura et al discloses a ceramic thermal barrier coating system in which NiCrAlY is covered with a reflective oxide, such as $ZrO_2$—$Y_2O_3$ or $ZrO_2$—MgO. The NiCrAlY has a thickness between 3 mils and 7 mils, and the coating is between 10 mils and 30 mils thick.

U.S. Pat. No. 4,248,940 to Goward et al is concerned with a thermal barrier coating for use on nickel or chromium alloy materials. The MCrAlY's are applied in a graded fashion from 100% metal at the metal coating interface to 100% coating on the surface. The patentee states this reduces problems associated with thermal shock due to material expansion.

U.S. Pat. No. 4,852,542 to Kamo et al sets forth several advantages and drawbacks of various ceramic coatings for use in engines. The thin coatings fail to provide sufficient heat buildup in the combustion chamber which is necessary for increased engine efficiency. Thick coatings add greatly to thermal efficiency, but cause over-heating resulting in increased maintenance and reduced life expectancy. The patentee proposes a coating not less than 2 mils or greater than 9 mils thick.

DISCLOSURE OF THE INVENTION

The aforementioned objects are achieved by utilizing a metallic "close-out" layer as a seal on a thermal barrier coating system. Ni-35Cr-6Al-1Y, Ni-35Cr-6Al-1Yb or other metallic alloy denoted as MCrAlX is applied over a zirconia-based thermal barrier overlayer and glass-bead peened to densify the surface to seal and protect the thermal barrier coating system.

The thickness of the "close-out" layer is at least four mils, although greater thicknesses to allow for machining may be envisioned. The "close-out" layer may be graded from ceramic to metal to reduce thermal shock.

BRIEF DESCRIPTION OF THE DRAWING

The foregoing, as well as other objects, features, and advantages of the invention will become more apparent from the following detailed description when taken in conjunction with the drawing which is an enlarged sectional view of a substrate coated in accordance with the present invention.

BEST MODE FOR CARRYING OUT THE INVENTION

Referring now to the drawing, there is shown a metal substrate 10 which is protected from high temperatures by a thermal barrier coating system embodying the features of the present invention. More particularly, the coating system comprises a bond coating 12 that is covered by a ceramic thermal barrier overlayer 14.

According to the present invention, a "close-out" layer 16 covers the ceramic thermal barrier overlayer 14. The "close-out" layer 16 seals the surface of the ceramic material in the overlayer 14.

The bond coating 12 is preferably NiCrAlY and is advantageously applied to the substrate 10 by plasma spraying, although cladding, slurry spray and sintering are examples of other suitable techniques that could be used for this purpose. The bond coating 12 has a thickness between three mils and seven mils.

The thermal barrier overlayer 14 contains a $Y_2O_3$ or MgO stabilized zirconia composition. This layer may be applied by plasma or flame spraying. The zirconia-yttria or zirconia-magnesia thermal barrier coating 14 is preferably between 0.002 inches and 0.100 inches thick. Intermediate layers of mixed metal and ceramic are also possible.

The "close-out" layer 16 is preferably Ni-35Cr-6Al-1Y (in weight percent), Ni-35Cr-6Al-1Yb, or another similar MCrAlX metallic alloy applied by plasma spraying, although flame spraying or cladding are examples of other suitable techniques that could be used for this purpose. The layer 16 should be at least four mils thick to ensure complete coverage although layers thick enough to allow machining are envisioned.

The "close-out" layer 16 is not sufficiently impermeable in the as-air-plasma sprayed conditioned. The preferred method for achieving sealing while retaining durability is to lightly glass bead peen the surface of the metallic seal. Other methods of lowering the permeability of the "close out" layer 16 are envisioned. These processes include grinding so as to smear the material, burnishing, or fusing with a laser or torch; these steps would be followed by stress relieving. It is also possible to apply a more dense "close-out" layer by shrouded or low pressure spraying.

In order to show the beneficial effect of the invention, test specimens sprayed in accordance with the present invention were tested in a Mach 0.3 burner rig. Each uncooled test specimen forming the substrate 10 was a standard one-half inch metal cylinder of a material known commercially as "Waspalloy". The thermal barrier coating system comprised about five mils of air plasma sprayed Ni-35Cr-6Al-1Y bond coating 12 and eleven mils of air plasma sprayed $ZrO_2$-8%$Y_2O_3$ ceramic layer 14.

A "close-out" layer 16 comprising about four additional mils of the material in the bond coating 12 was then air plasma sprayed onto the surface of the zirconia-yttria overlayer 14.

The coating was tested by repeatedly cycling the rotating specimen between the burner rig flame and a cooling air jet. Time in the flame for each cycle was three minutes and the maximum surface temperature of 1472° F. (800° C.) as measured with a two color pyrometer. Time in the cooling air jet was two minutes which was sufficient to cool the specimen to near room temperature as measured with an infrared pyrometer. The specimen survived this cycle for 1319 times, although the cooling air jet was inadvertently not employed for the first 255 cycles. After this testing, the specimen was observed to be lightly oxidized, but no evidence of failure was observed.

Another specimen was sprayed in a manner similar to the first except that the bond coating 12 was eight mils thick, the ceramic overlayer 14 was ten mils thick, and the "close out" or metallic seal layer 16 was 29 mils thick. This specimen was cycled as previously described above for 3396 cycles. Again, light oxidation but no sign of failure was observed.

These first two tests demonstrated that metallic "close out" layers could be durable on top of thermal barrier coating systems. However, permeability tests showed that the air plasma sprayed "close out" layer did not seal well. Subsequent permeability tests showed that a light glass bead peening with "100 to 170 mesh" micron beads at a blast pressure of 30 psi and a stand-off distance of about five inches effectively sealed the "close out" layer 16.

Therefore, a third specimen was prepared in a manner similar to the first two. The thicknesses for the bond coat, the ceramic overlayer, and the "close out" layer were 9, 11 and 32 mils, respectively. This specimen was glass bead peened as previously described and exposed to 1671 of the same burner rig cycles that were employed for the first two specimens. Again, light oxidation but no failure was observed.

An additional specimen was prepared. For this specimen, the one-half inch "Waspalloy" rod was replaced with a 1.5 inch outside diameter/0.25 inch inside diameter stainless steel tube.

The stainless steel tube was coated with seven mils of bond coat, ten mils of ceramic overlayer, and nine mils of the "close out" layer. The "close out" layer was then lightly peened as described above.

This tubular specimen was exposed to the burner rig flame between 930° F. (500° C.), as measured with an infrared pyrometer and room temperature in a manner similar to but in some ways significantly different from that previously described for the three solid specimens. The most important difference was that cold water was allowed to flow through the interior of the specimen. Also, the specimen was not rotated and, since the specimen cooled quickly, it was only cooled for one minute per cycle. It is estimated that approximately 50% of the roughly 850° F. (450° C.) temperature drop from the outer surface to the inner surface of the specimen was born by the ceramic layer. The specimen was exposed for 826 cycles with light oxidation but without failure.

The test temperature was then raised to about 1110° F. (600° C.) and the specimen was exposed for 1002 cycles without failure. However, the apparent oxidation was heavier. The emissivity value had increased to 0.47 versus the value of 0.25 to 0.31 that was associated with light oxidation. It is possible that contaminants known to have been present in the cooling air during this test may have contributed to the heavier oxidation. When exposed to 1310° F. (710° C.) failure by spalling was observed within 300 cycles, and another specimen exposed to 1470° F. (800° C.) failed in two cycles.

Other variations to the above invention were attempted with less success. These included Ni, Ni-16Cr-6Al-Y, a FeCrAlSiZr, and FeCrAlY alloy. Grinding so as to smear the "close-out" layer sealed the surface, but led significantly to degraded durability. Low pressure plasma sprayed FeCrAlSiZr and Ni-16Cr-6Al-Y were also attempted without success.

While the preferred embodiment of the invention has been disclosed and described, it will be appreciated that various modifications can be made to the invention without departing from the spirit thereof or the scope of the subjoined claims.

I claim:

1. A method of applying a thermal barrier coating system to a metal substrate that is to be used in a corrosive environment at temperatures between about 300° C. and about 700° C. comprising the steps of plasma spraying a NiCrAlY bond coating onto a surface of said substrate to a thickness between about three mils and about seven mils, plasma spraying a thermal barrier overlayer of zirconia stabilized with an oxide selected from the group consisting of yttrium and magnesia onto said bond coating to a thickness between about 0.002 inch and 0.100 inch. plasma spraying a NiCrAlY metal closed-out layer onto said stabilized zirconia thermal barrier overlayer to a thickness of at least four mils to seal said overlayer, said close-out layer being the same NiCrAlY composition as said bond coating, and densifying the surface of the NiCrAlY close-out layer by glass bean peening with 100 to 170 mesh beads at a blast pressure of 30 psi and a stand-off distance of about five inches to seal said surface while retaining durability of said thermal barrier coating.

* * * * *